United States Patent [19]

Samuel

[11] Patent Number: 4,723,522

[45] Date of Patent: Feb. 9, 1988

[54] ELECTRONIC CONTROL SYSTEM FOR AN IC ENGINE

[75] Inventor: James J. Samuel, Essington, United Kingdom

[73] Assignee: Lucas Electrical Electronics & Systems Ltd., United Kingdom

[21] Appl. No.: 919,450

[22] Filed: Oct. 16, 1986

[30] Foreign Application Priority Data

Oct. 16, 1985 [GB] United Kingdom ..... 8525435

[51] Int. Cl.[4] ..... F02M 51/00

[52] U.S. Cl. ..... 123/489; 123/494

[58] Field of Search ..... 123/440, 489, 492, 493, 123/494

[56] References Cited

U.S. PATENT DOCUMENTS

| | | | |
|---|---|---|---|
| 4,392,471 | 7/1983 | Miyagi et al. | 123/440 X |
| 4,441,473 | 4/1984 | Isomura et al. | 123/489 X |
| 4,502,443 | 3/1985 | Hasegawa et al. | 123/489 X |
| 4,509,489 | 4/1985 | Hasegawa et al. | 123/489 |

*Primary Examiner*—Willis R. Wolfe, Jr.
*Attorney, Agent, or Firm*—Stevens, Davis, Miller & Mosher

[57] ABSTRACT

In an engine management system which stores a control value FBPOS and increments or decrements this according to whether an oxygen sensor in the exhaust stream indicates that the engine is running lean or rich and which controls the duration of pulses applied to fuel injectors of the engine according to the deviation of the actual control value FBPOS from a reference value, a compensating adjustment is determined and applied to the pulse length duration in order to reduce any difference in the level of the actual control value FBPOS as between the closed-throttle running condition and either the open-throttle running condition or the reference value. The system thus serves to reduce the time taken to readjust upon opening and closing of the throttle and to minimize the emission of pollutants from the engine exhaust.

13 Claims, 5 Drawing Figures

ELECTRONIC CONTROL SYSTEM FOR AN IC ENGINE

This invention relates to an electronic control system for an internal combustion engine, or engine management system, and is in particular concerned with regulation of the exhaust emission.

Systems are known which exercise a control on the proportions of air and fuel which are fed to the engine, such that the fuelling cycles continuously between lean and rich conditions (with the effect that the exhaust cycles between having a surplus and a deficit of oxygen). A catalyst disposed in the exhaust stream serves to ensure that only very low levels of pollutants are emitted into the atmosphere. In order to carry out the control just mentioned, an oxygen sensor is disposed in the exhaust stream just upstream of the catalyst, and provides an electrical voltage the level of which indicates whether the engine is running rich or lean. If the oxygen sensor provides a "rich" indication, then the proportion of fuel is gradually decreased until the sensor indicates "lean" and changes state accordingly, whereafter the proportion of fuel is gradually increased until the sensor indicates "rich" and changes state again: thus the engine continuously cycles between rich and lean running conditions.

One way which we have found satisfactory for achieving this control is by controlling the length of the actuating pulses supplied to the fuel injectors of the engine, in the following manner. Thus, the injector pulse length is modified according to the difference between a stored control values FBPOS and a stored reference value: the control value is increased in steps (if the oxygen sensor indicates a lean condition) to increase the injector pulse length in corresponding steps, until the oxygen sensor changes states, indicating a rich running condition; then the control value FBPOS is reduced in steps to correspondingly reduce the injector pulse length, until the oxygen sensor changes state again. At each change in state of the sensor, the first step-change made to the FBPOS value is relatively large. This process continues, causing the required continuous cycling between rich and lean running conditions. The electronic system has an open-loop mode, in which the output from the oxygen sensor is disregarded, and the stored control value FBPOS reverts to its reference value: this open-loop mode is adopted whilst the engine is warming to a predetermined temperature at start-up.

The injector pulse length is also dependent on other sensed parameters of the engine, including particularly inlet airflow (representing engine load), engine speed, and throttle position. The design arrangements are such that the control value FBPOS should always cycle around the reference value. However, variations from engine-to-engine, and also engine wear, mean that in practice this condition does not always occur. In particular, there can be quite a substantial difference between the values of FBPOS when the throttle is closed (engine idling) and its values when the throttle is open (engine over idling). Without any compensation for this, the control value FBPOS must be changed considerably (by way of its successive step-changes) each time the throttle is closed or opened, before it can resume its usual cycling, and this change occupies a significant time period: during this time period, there is no effective control exercised by the oxygen sensor and indeed high concentrations of pollutants would be emitted into the atmosphere. Hitherto it has been possible to compensate for this manually, by providing a voltage output which represents the value of FBPOS under closed-throttle condition, and a voltage input which serves to alter accordingly the injector pulse length under closed-throttle: this eliminates or reduces the time periods, occuring when the throttle is opened or closed, during which the oxygen sensor feedback is ineffective. However, the technique only deals with engine-to-engine variations and not with progressive engine wear, and (being manual) is labour intensive.

An object of this invention is to provide a system which is self-regulating in respect of the control value FBPOS, so as to eliminate or substantially reduce the time period, when the throttle is opened or closed, that the control value FBPOS does not undergo its required cycling.

In accordance with this invention, there is provided an electronic control system for an internal combustion engine, comprising a sensor for disposing in the engine exhaust stream and arranged to provide an indicating signal as to whether the engine is running rich or lean, a central control unit storing a control value FBPOS and responsive to said indicating signal to increment or decrement said stored control value according to whether that signal indicates the engine is running lean or rich, and an output from said control unit for providing an actuating signal for controlling the amount of fuel delivered to the engine, the control unit being arranged to control said actuating signal in accordance with the deviation of the actual control value FBPOS from a reference value thereof, and the control unit being further arranged to respond to any difference in level of the actual control value, as between closed-throttle and open-throttle running conditions or between the closed-throttle condition and a reference value, so as to apply a compensating adjustment to the actuating signal, tending to reduce that difference.

In one embodiment, the control system effects relative adaption, by determining an average of the control value FBPOS under the closed-throttle condition and its average under the open-throttle condition, then determining the compensating adjustment (or trim) in accordance with the difference between these averages. In this embodiment, the trim is applied when the engine is running under its closed-throttle condition.

In a second embodiment, the control system effects absolute adaption, by determining the average of the control value FBPOS under the closed-throttle condition, then determining the difference between this average and the reference value for the control value FBPOS. A trim is then applied to the actuating signal in accordance with the difference between the closed-throttle FBPOS average and the reference value.

This principle of absolute adaption may be extended by arranging the control unit to determine the average control value FBPOS prevailing under various different combinations of engine running conditions (e.g. engine load and speed), so as to provide for modifying the actuating signal differently under the respective conditions, all with a view to stabilising the actual vaue FBPOS so that it always cycles around its reference value.

In the preferred embodiments an oxygen sensor provides the indicating signal. Also the actuating signal consists of pulses applied to fuel injectors of the engine and the duration of these pulses is controlled in order to control the amount of fuel delivered to the engine.

Embodiments of this invention will now be described by way of examples only and with reference to the accompanying drawings, in which:

FIG. 1 is a schematic block diagram of an electronic control system used with an internal combustion engine;

FIGS. 2(*a*) and (*b*) are diagrams to show typical changes in level of an output signal derived from an oxygen sensor disposed in the exhaust stream from the engine, and to show corresponding cycling of a control value FBPOS within the control system;

Figure 1:
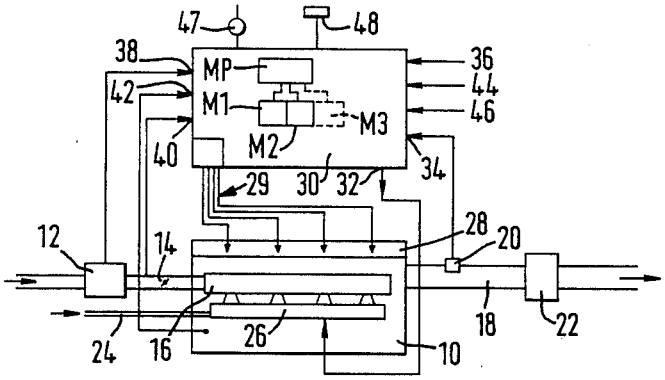

Referring to FIG. 1, there is shown an internal combustion engine 10 to be controlled. Air passes to the engine through an airflow meter 12 and a throttle 14 via an inlet manifold diagrammatically indicated at 16. The exhaust is carried through a duct 18 in which is disposed an oxygen sensor 20 and a catalyst 22. Fuel to the engine is supplied through a feed pipe 24 under constant pressure to injectors 26 which serve to inject the fuel into the inlet manifold.

An electronic control system for the engine is shown diagrammatically and comprises a microprocessor-based digital control unit 30. An output 32 supplies pulses to actuating solenoids of the fuel injectors 26 and the length or duration of these pulses is determined by the control system, in accordance with its various inputs, so as to correspondingly control the length of the intermittent periods for which the injectors are open. The control system has an input 34 receiving an output signal from the oxygen sensor 20, an input 36 derived from the engine and indicating engine speed, an input 38 from the airflow meter 12 indicating the air flow-rate and thus representing the engine load, an input 40 from the throttle to indicate the throttle position, an input 42 from the engine cooling system to indicate the engine coolant temperature, an input 44 indicating the inlet air temperature, and an input 46 indicating the ambient air temperature. The control system includes an ignition system 28 for providing ignition pulses to the engine spark plugs as appropriate over lines 29. A power line for the control system via the ignition switch 47 is shown and also a power line from a standby battery 48 to maintain the volatile memories whilst the ignition is switched off.

In accordance with known principles, the control unit 30 responds to the inputs 38,36,42,40 representing airflow (engine load), engine speed, coolant temperature and throttle position (opened or closed) to determine the fuel requirement and hence the length or duration of the pulses supplied to the fuel injectors from its output 32. However in addition, the control unit modifies the thus-determined pulse length in accordance with the output from the oxygen sensor 34, in the manner which will now be described.

Figure 2:
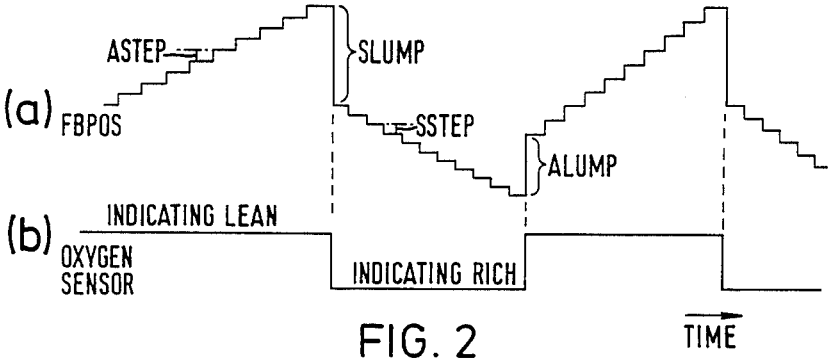

Referring to FIG. 2*b*, the control unit responds to the output from the oxygen sensor 20 to provide the signal shown, which is of high level if there is a surplus of of oxygen in the exhaust and of low level if there is a deficit of oxygen (indicating that the engine is running on a lean or rich mixture respectively).

In a memory M1 of the control unit 30, a control value FBPOS is stored, and the control unit 30 provides modification of the injector pulse length, for emission control, dependent on the stored value. If the stored value is equal to a reference value FBREF, there is no modification of the pulse length as determined by the other monitored parameters: otherwise, the amount of modification depends on the deviation of the actually-stored FBPOS value from its reference value. Also, the control unit 30 has an open-loop mode, in which the signal from the oxygen sensor 20 signal is ineffective and the stored value FBPOS is set to its reference value FBREF: this open-loop mode is adopted whilst the engine is warming to a predetermined temperature at start-up, as indicated at input 42 to the control unit.

As shown in FIG. 2*a*, in the closed-loop mode and whilst the oxygen sensor 20 is indicating a lean mixture, the control unit microprocessor MP serves to increase the stored control value FBPOS by steps A STEP at intervals: this has the effect of progressively increasing the pulse length and thus enriching the mixture, until the oxygen sensor 20 detects a sufficiently rich mixture that the signal shown in FIG. 2*b* changes to its low level. In response to this, the control unit 30 reduces the stored control value FBPOS by a relatively large amount S LUMP, then decreases the stored control value by steps S STEP at intervals: this has the effect of progressively decreasing the pulse length and thus weakening the mixture until the oxygen sensor 20 detects a sufficiently weak mixture that the signal of FIG. 2*b* changes back to its high level. In response to this, the control unit 30 increases the stored control value FBPOS by a relatively large amount A LUMP and then increases it again by the steps A STEP at intervals, as previously described.

This sequence applies for the closed-loop mode (in which the oxygen sensor 20 exercises the control described), and the changes in FBPOS can be expressed as:

FBPOS=FBPOS−S STEP (if sensor indicates rich). (1)

FBPOS=FBPOS+A STEP (if sensor indicates lean). (2)

FBPOS=FBPOS−S LUMP (change: lean to rich). (3)

FBPOS=FBPOS+A LUMP (change: rich to lean). (4)

A STEP, S STEP, A LUMP and S LUMP are application-dependent constants and the rate of update of the stored control value FBPOS can be N times per second or N times per engine revolution, again depending upon the application (e.g. type and size of engine).

The stored control value FBPOS thus continuously cycles in the manner shown in FIG. 2*a* so that the air/fuel mixture continuously cycles between rich and lean. This ensures correct working of the catalyst 22, which in the example shown is a three-way catalyst which serves to oxidise carbon monoxide and hydrocarbons in the exhaust stream but also to reduce oxides of nitrogen.

Figure 3:
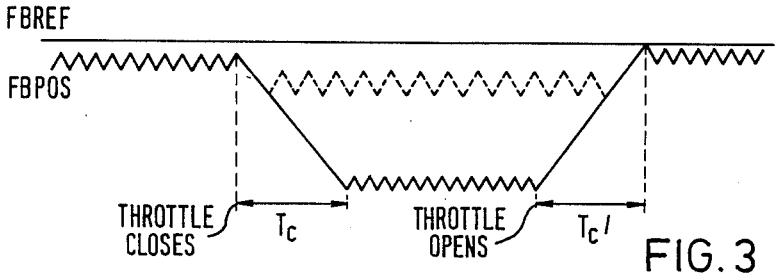
FIG. 3 is a diagram to illustrate differences which may arise in practice, in the absence of the control exercised in accordance with this invention, between the control value FBPOS when under closed-throttle condition and the control value when under open-throttle condition.

The control system is arranged so that the control value FBPOS should cycle around its reference value FBREF. However as mentioned previously, in the absence of a compensation provided in accordance with this invention, variations from engine-to-engine and engine wear mean that this does not occur in practice. In particular, as shown in FIG. 3 for example, the control value FBPOS may cycle (when the throttle is closed) around a level substantially different from the open-throttle level: in this example, when the throttle is closed, the control value must fall significantly to the level around which it will now cycle, then when the throttle is opened it must rise through a similar amount to reach the open-throttle cycling level. These changes in level of the control value take significant time durations Tc, Tc', during which the oxygen sensor is exercising no control and indeed relatively high levels of pollutants may pass through the exhaust.

In accordance with one embodiment of this invention, the control unit effects a relative adaption technique with a view to reducing the time durations TC, TC' to a minimum. This embodiment is expressed in the flow-diagram of FIG. 4, which sub-routine is executed each time the control value FBPOS is updated. Thus, at step 54 the microprocessor MP determines an average FBAVc of the control value under closed-throttle conditions in accordance with the following:

$$FBAV_c=(1-\alpha)FBAV_c+\alpha FBPOS_T \quad (5)$$

Also, at step 55 the microprocessor MP determines an average FBAVo of the control value under open-throttle conditions in accordance with the following:

$$FBAV_o=(1-\alpha)FBAV_o+\alpha FBPOS_T \quad (6)$$

Figure 4:
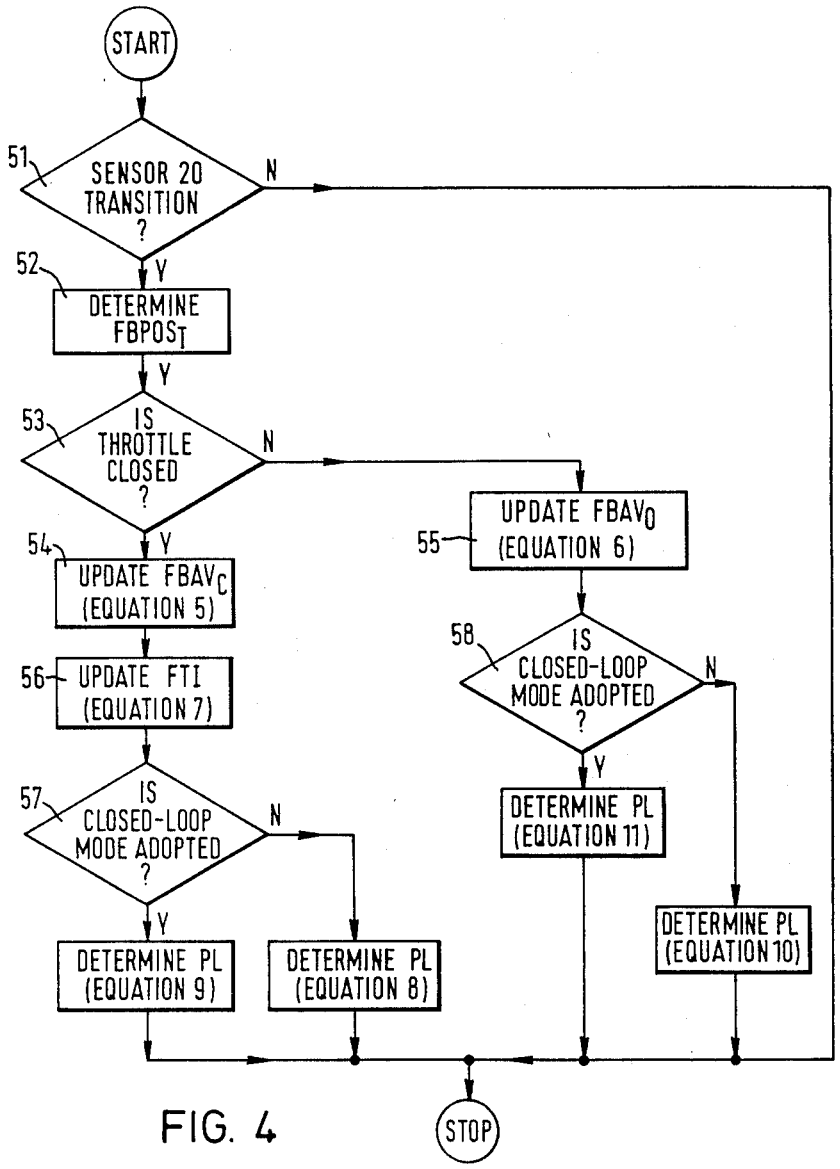
FIG. 4 is a flow-diagram illustrating a sub-routine employed in a first embodiment of the invention for applying a compensating adjustment to the actuating signal controlling the amount of fuel delivered to the engine.

Whether the engine is under closed-throttle or open-throttle conditions is indicated on input 40 to the control unit 30 and determined at step 53 in FIG. 4. In each of the expressions 5 and 6, $\alpha<1$ and $FBPOS_T$ is the actual control value FBPOS (recorded at step 52 in FIG. 4) after a change in the sensor signal shown in FIG. 2*b*. Each of the averages $FBAV_c$ and $FBAV_o$ is initially set to the FBREF value, and each average is updated on each change or transition in the signal from sensor 20 (respectively under closed or open-throttle conditions) as provided by step 51 in FIG. 4.

From these average values $FBAV_c$ and $FBAV_o$, the microprocessor determines a trim value FTI for adjusting the injector pulse length:

$$FTI = FTI + \left(\frac{FBAV_c - FBAV_o}{K_o}\right) \quad (7)$$

This updating of the trim value FTI is however conditional on $FBAV_c>FBAV_o$ and $FBPOS_T>FBAV_o$, or $FBAV_c\leqq FBAV_o$ and $FBPOS_T\leqq FBAV_o$: otherwise FTI maintains its present value. FTI is initially set to a reference value FTREF and is updated each time $FBAV_c$ is updated, see step 56 in FIG. 4. The value of this trim FTI and the average FBPOS values are stored in a memory M2 of control unit 30 and remain so-stored even when ignition power is removed from the control unit.

The constants $\alpha$ and $K_o$ are chosen to maximise the speed of adaption and the stability for a given application.

The injector pulse length is determined by the microprocessor MP as follows. Considering firstly the closed-loop mode, determined at steps 57 or 58 in FIG. 4 and according to the temperature input at 42 of the control unit, the injector pulse length PL for open-throttle condition is given by:

$$PL = BVC + \left(FW * \Sigma CT * \left(\Sigma TH + \left(\frac{FBPOS - FBREF}{K_1}\right) + FTREF\right)\right) * K \quad (8)$$

where BVC is a correction for battery voltage, FW is a term related to the engine load and speed, ΣCT is a sum of temperature-dependent trims (i.e. trims dependent on e.g. coolant temperature, fuel temperature, inlet and ambient air temperatures), ΣTH is a sum of throttle-dependent trims (i.e. trims dependent on e.g. rate of change of throttle position, whether throttle is in full load position, whether it is progressively closing—i.e. for deceleration), and K and $K_1$ are constants. In the above closed-loop, open-throttle expression for PL, the term (FBPOS-FBREF) will be noted (the deviation of the actual FBPOS value from its reference value), also the term FTREF (being the reference value for the trim FTI).

In the closed-loop, closed-throttle condition, the pulse length PL is given by:

$$PL = BVC + \left(FW * \Sigma CT * \left(\Sigma TH + \left(\frac{FBPOS - FBREF}{K_1}\right) + FTI\right)\right) * K \quad (9)$$

and in this case the term (FBPOS-FBREF) still appears but now the trim term is the actual stored value FTI.

In the open-loop mode, for open-throttle:

$$PL=BVC+(FW*\Sigma CT*(\Sigma TH+0+FTREF))*K \quad (10)$$

and for closed throttle:

$$PL=BVC+(FW*\Sigma CT*(\Sigma TH+0+FTI))*K \quad (11)$$

and in this open-loop mode the (FBPOS-FBREF) term disappears (and is represented by 0 in these expressions for the sake of comparison) because FBPOS is set to the reference value FBREF: also the reference value FTREF value for FTI will be noted for open-throttle and its replacement by the actual stored value FTI for closed throttle.

As mentioned previously, the open-loop mode is adopted whilst the engine is warming to a predetermined temperature at start-up as indicated at input 42 to the control unit, then the closed-loop mode is adopted.

With the control system in accordance with the above-described embodiment of the invention, the control value FBPOS behaves rather as shown in dotted lines in FIG. 3 when the throttle is closed for a period and then re-opened.

Figure 5:
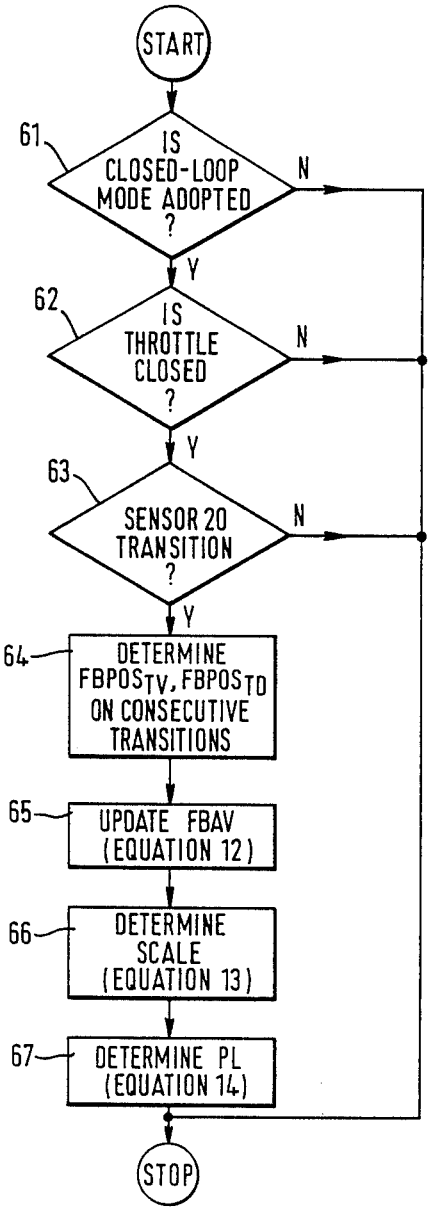
FIG. 5 is a similar flow diagram relating to a second embodiment of the invention.

In accordance with a second embodiment of this invention the control unit 30 effects an absolute adaption technique. This is based on the assumption that the fuelling behaves correctly under closed-loop, closed-throttle and that an average of the FBPOS value can be determined under these conditions. FIG. 5 shows the sub-routine which is executed each time the control value FBPOS is updated and which applies under closed-loop, closed-throttle conditions (determined at steps 61,62). The average FBAV is determined by the microprocessor MP at step 65 in accordance with:

$$FBAV = (1 - \alpha)FBAV + \alpha\left(\frac{FBPOS_{TV} + FBPOS_{TD}}{2}\right) \quad (12)$$

where $\alpha < 1$, and $FBPOS_{TV}$ and $FBPOS_{TD}$ are the control values determined at steps 63,64 after consecutive up and down transitions of the sensor.

A scaling term SCALE for the injector pulse length is then determined at step 66 by:

$$SCALE = (FBAV - FBREF)\beta + (1 - \beta)SCALE \quad (13)$$

where as previously FBREF is the reference value of the control value FBPOS.

The injector pulse width for closed-loop, closed-throttle is now determined at step 67 by:

$$PL = \frac{MV * SCALE}{K_2} + BVC \quad (14)$$

where $K_2$ is a constant and MV is given by:

$$MV = FW * \Sigma CT\left(\Sigma TH + \frac{FBPOS - FBREF}{K_1}\right) \quad (15)$$

The value of SCALE and the average FBPOS value remain stored in the memory M2 of the control unit 30 even when ignition power is removed from the control unit.

In accordance with known principles, the values FW may be stored or mapped in a memory M3 of the control unit 30, which memory is addressed in accordance with the sensed values of engine load and speed, to access the correct mapped value for the particular operating condition.

In an extension of the absolute adaption technique, the microprocessor MP may be programmed to determine the average of the control value FBPOS under various different conditions of engine load and speed etc. so as to provide for modifying the injector pulse length differently under the respective conditions and with a view to stabilising the actual control value FBPOS so that it always cycles around its reference value FBREF. In particular, the mapped value memory M3 may be electrically erasable and reprogrammable, so that each time a freshly-determined average of the control value FBPOS indicates that an updating is required of the corresponding mapped value for the particular engine conditions prevailing, then the mapped value memory M3 can be updated at its particular corresponding location.

What is claimed:

1. An electronic control system for an internal combustion engine, said engine including an exhaust stream and a throttle having open and closed positions, said control system comprising:

a sensor means, responsive to the engine exhaust stream for providing a first indicating signal when the engine is running rich and a second indicating signal when the engine is running lean;

a throttle-position detector means for providing a closed-throttle signal when the throttle is closed and an open-throttle signal when the throttle is open;

a central control unit means for storing a control value FBPOS;

means, responsive to said indicating signals, for respectively incrementing and decrementing said stored control value FBPOS;

means for determining any deviation of the stored control value from a reference value thereof;

an output means, responsive to said determining means, for providing an actuating signal for controlling the amount of fuel delivered to the engine;

means, responsive to said closed-throttle and open-throttle signals, for determining any difference in the stored control value between the closed-throttle running condition and one of the open-throttle running condition and said reference value; and means, responsive to said difference, for applying a compensating adjustment to said actuating signal, tending to reduce that difference.

2. An electronic control system as claimed in claim 1, in which the control unit means comprises means to determine an average $FBAV_c$ of the stored control value under the closed-throttle condition and to determine an average $FBAV_o$ of the stored control value under the open-throttle condition, and in which said difference-responsive means is adapted to determine said compensating adjustment in accordance with the difference between these two averages.

3. An electronic control system as claimed in claim 2, in which said averages $FBAV_c$ and $FBAV_o$ of the control value are determined in accordance with:

$$FBAV_c = (1 - \alpha)FBAV_c + \alpha FBPOS_T$$

and $$FBAV_o = (1 - \alpha)FBAV_o + \alpha FBPOS_T$$

where $\alpha < 1$ and $FBPOS_T$ is the stored control value after a transition in said indicating signal.

4. An electronic control system as claimed in claim 3, in which a said compensating adjustment FTI is determind in accordance with:

$$FTI = FTI + \left(\frac{FBAV_c - FBAV_o}{K_o}\right)$$

5. An electronic control system as claimed in claim 4, in which said compensating adjustment FTI is applied additively to said actuating signal.

6. An electronic control system as claimd in claim 2, in which the compensating adjustment FTI is applied to said actuating signal when the engine is running under closed-throttle conditions.

7. An electronic control system as claimed in claim 1, in which the control unit means comprises means to determine an average FBAV of the stored control value under the closed-throttle condition, and said difference-responsive means is adapted to determine said compensating adjustment in accordance with the difference between this average and said reference value FBREF.

8. An electronic control system as claimed in claim 7, in which said average FBAV of the control value under closed-throttle condition is determined in accordance with:

$$FBAV = (1 - \alpha)FBAV + \alpha\left(\frac{FBPOS_{TV} + FBPOS_{TD}}{2}\right)$$

where $\alpha < 1$ and $FBPOS_{TV}$ and $FBPOS_{TD}$ are the control values after consecutive transitions in said indicating signal.

9. An electronic control system as claimed in claim 8, in which a said compensating adjustment SCALE is determined in accordance with:

$$SCALE = (FBAV - FBREF)\beta + (1 - \beta)SCALE$$

10. An electronic control system as claimed in claim 9, in which said compensating adjustment SCALE is applied multiplicatively to said actuating signal.

11. An electronic control system as claimed in claim 7, in which the compensating adjustment SCALE is applied to said actuating signal when the engine is running under closed-throttle conditions.

12. An electronic control system as claimed in claim 1, in which the control unit means further comprises means adapted to determine an average of the control value under different combinations of engine running conditions and to determine a said compensating adjustment for the different combinations of conditions in accordance with the difference between the average for the respective combination and said reference value.

13. An electronic control system as claimed in claim 12, in which the control unit means comprises a mapped value memory which stores values determining said actuating signal in accordance with different combinations of engine running conditions, said memory being reprogrammable in respect of its stored values and said control unit means being arranged to update said memory in accordance with a freshly-determined average of the control value for a respective combination of engine conditions.

* * * * *